US007749570B2

(12) United States Patent
Rucker et al.

(10) Patent No.: US 7,749,570 B2
(45) Date of Patent: Jul. 6, 2010

(54) METHOD FOR DEPOSITING A PLATINUM-GROUP-CONTAINING LAYER ON A SUBSTRATE

(75) Inventors: Michael Howard Rucker, Cincinnati, OH (US); Andrew Jay Skoog, West Chester, OH (US); Jane Ann Murphy, Franklin, OH (US)

(73) Assignee: General Electric Company, Schenectady, NY (US)

( * ) Notice: Subject to any disclaimer, the term of this patent is extended or adjusted under 35 U.S.C. 154(b) by 239 days.

(21) Appl. No.: 11/613,507

(22) Filed: Dec. 20, 2006

(65) Prior Publication Data

US 2008/0152814 A1 Jun. 26, 2008

(51) Int. Cl.
*B05D 1/38* (2006.01)

(52) U.S. Cl. ..... 427/383.1; 427/383.7; 427/405; 427/427; 427/427.1

(58) Field of Classification Search ..... 427/383.1, 427/383.7, 404, 405, 427, 427.5, 250
See application file for complete search history.

(56) References Cited

U.S. PATENT DOCUMENTS

| | | | | |
|---|---|---|---|---|
| 3,672,032 | A * | 6/1972 | Witherspoon | 29/424 |
| 4,396,480 | A | 8/1983 | Hegedus et al. | |
| 4,913,970 | A * | 4/1990 | Hayward et al. | 428/423.7 |
| 5,034,275 | A * | 7/1991 | Pearson et al. | 428/336 |
| 5,306,411 | A | 4/1994 | Mazanec et al. | |
| 5,569,633 | A | 10/1996 | Carolan et al. | |
| 5,648,416 | A * | 7/1997 | Miller et al. | 524/500 |
| 5,686,012 | A * | 11/1997 | Hayashi et al. | 252/62.56 |
| 5,753,316 | A * | 5/1998 | Brent et al. | 427/486 |
| 6,060,174 | A * | 5/2000 | Sabol et al. | 428/610 |
| 6,333,068 | B1 * | 12/2001 | Durand et al. | 427/136 |
| 6,395,406 | B1 | 5/2002 | Sangeeta | |
| 6,893,737 | B2 * | 5/2005 | Ackermann et al. | 428/650 |
| 2002/0094445 | A1 | 7/2002 | Sangeeta et al. | |
| 2003/0152705 | A1 | 8/2003 | Pfaendtner et al. | |
| 2004/0115355 | A1 | 6/2004 | Bauer et al. | |
| 2004/0126496 | A1 | 7/2004 | Ackermann et al. | |
| 2005/0235869 | A1 | 10/2005 | Cruchon-Dupeyrat et al. | |
| 2005/0266157 | A1 | 12/2005 | Richin et al. | |
| 2006/0257633 | A1 | 11/2006 | Inoue et al. | |
| 2009/0057436 | A1 * | 3/2009 | Valdes et al. | 239/9 |

FOREIGN PATENT DOCUMENTS

| | | | |
|---|---|---|---|
| EP | 0397114 | * | 5/1990 |
| EP | 1079002 | A1 | 2/2001 |

(Continued)

OTHER PUBLICATIONS

Oglesby, Donald M., et al., "Water-Based Pressure Sensitive Paint." NASA-TM-2004-213268. Oct. 2004, no page numbers.*

*Primary Examiner*—Bret Chen
(74) *Attorney, Agent, or Firm*—McNees Wallace & Nurick, LLC

(57) ABSTRACT

A method for depositing a platinum-group-containing layer on a substrate includes furnishing the substrate, and preparing a water-base paint containing metallic platinum-group powder, water, and a binder. The method further includes spraying the water-base paint overlying the substrate to form a platinum-group-containing layer, and thereafter heating the platinum-group-containing layer to interdiffuse the platinum-group-containing layer.

16 Claims, 3 Drawing Sheets

FOREIGN PATENT DOCUMENTS

| | | | |
|---|---|---|---|
| EP | 1091020 | A1 | 4/2001 |
| EP | 1528117 | A1 | 4/2005 |
| EP | 1772530 | A2 | 4/2007 |
| WO | 9850313 | | 11/1998 |
| WO | 2005007922 | A1 | 1/2005 |

* cited by examiner

METHOD FOR DEPOSITING A PLATINUM-GROUP-CONTAINING LAYER ON A SUBSTRATE

This invention relates to the deposition of a platinum-group-containing layer on a surface and, more particularly, to deposition using a water-base platinum-group-containing paint that is applied by spraying.

BACKGROUND OF THE INVENTION

A platinum-group-containing layer may be applied to the surfaces of a substrate to improve the corrosion resistance and oxidation resistance of the substrate. The platinum-group precious metals do not react to any substantial degree with oxygen, exhaust gas, or most other common oxidants and corrodants. The result is that the substrate with the platinum-group-containing layer thereon is at least partially inert in such environments. Platinum-group metals are expensive, but the improvement in properties produced by even a thin platinum-group-containing layer often justifies the cost.

One approach to applying a platinum-group-containing layer is electrodeposition. The substrate to be protected is made the cathode of an electrochemical cell in which the electrolyte is a platinum-group-containing salt. The application of an electrical current results in the deposition of the platinum-group metal onto the substrate. Electrodeposition is slow and can be difficult to apply in practice, such as in conditions where the substrate is irregularly shaped or the platinum-group layer is to be deposited only in selected areas of the surface of the substrate.

An alternative approach that has been considered is to apply the platinum-group metal from a platinum-group-containing paint. The proposed approaches are not environmentally acceptable, because they release volatile organic components during one or more of the processing steps.

There is a need for an improved approach to the deposition of a platinum-group-containing layer on a substrate. Such an approach must be compatible with other processing steps and be environmentally acceptable. The present invention fulfills this need, and further provides related advantages.

SUMMARY OF THE INVENTION

The present invention provides a method for depositing a platinum-group-containing layer overlying a substrate. The layer is deposited from a water-base platinum-group-containing paint that contains no volatile organic compounds whose release would be detrimental to the environment. Organic solvents often leave residues or produce volatile organic compounds when heated, and the present approach avoids these detrimental features. The deposition is preferably performed by spraying, which produces a uniform deposited layer of controllably small thickness. The spraying approach is fast and economical. The deposition of a platinum-group-containing layer on a complexly shaped article, and the masking of areas that are not to be coated, are readily accomplished.

In accordance with the invention, a method for depositing a platinum-group-containing layer on a substrate comprises the steps of furnishing the substrate, preparing a water-base paint comprising metallic platinum-group powder, water, and a binder, and depositing the water-base paint overlying the substrate to form a platinum-group-containing layer. Liquid water is the carrier for the remaining metallic and binder components, and no liquid organic carrier is used.

As used herein, the "platinum group" of elements includes platinum, palladium, rhodium, iridium, ruthenium, and osmium. A "platinum-group-containing layer" may include any one of these elements of the platinum group, or a mixture of elements of the platinum group.

Preferably, the substrate is a nickel-base superalloy substrate. There is no limitation on the types of substrates and articles that may be provided with the platinum-containing layer, but some examples of interest are a turbine blade, a turbine vane, and a combustor splash plate.

In one preferred application, the water-based paint is prepared by mixing together from about 25 to about 40 percent by weight metallic platinum-group powder, from about 10 to about 30 percent by weight binder, balance water. The preferred binder is methyl cellulose.

The water-base paint may be deposited by any operable technique. However, a preferred approach is spraying the water-base paint overlying the substrate. Spraying, as with an air or airless sprayer, is fast, and can produce a uniform layer on the substrate, both before and after a subsequent diffusion heat treatment. The application of the water-base paint desirably produces the platinum-group-containing layer in a thickness of from about 0.0001 to about 0.0003 inches of high-purity platinum group metal after a heat treatment of 1950° F. for 4 hours. The platinum-group-containing layer desirably includes at least about 96 percent, most preferably at least about 99 percent, platinum-group metal (or mixture of platinum-group metals) by weight exclusive of the water and the binder. After a heat treatment of 1950° F. for 4 hours, there is no water and no binder in the platinum-group-containing layer. It is preferred that there be less than about 100 parts per million (ppm), more preferably less than about 25 ppm, total of the elements sulfur and carbon.

The platinum-group-containing layer may be left unmodified on the substrate. More typically, however, the platinum-group-containing layer is heated to interdiffuse the platinum-group-containing layer into the underlying layer, which may be the substrate or a previously deposited underlayer.

One application of the present approach is to transform the platinum-group-containing layer into an alloy layer, preferably with aluminum. Various platinum-group/aluminum compositions provide excellent corrosion and oxidation protection for the underlying substrate. In this approach, there may be an additional step of depositing an aluminum-containing layer in contact with the platinum-group-containing layer. It is preferred to heat the aluminum-containing layer and the platinum-group-containing layer to interdiffuse the aluminum-containing layer and the platinum-group-containing layer. The heating of the aluminum-containing layer and the platinum-group-containing layer to accomplish interdiffusion may be performed concurrently with the deposition of the aluminum-containing layer, or after the deposition of the aluminum-containing layer is complete, or both.

The platinum-group-containing layer may be deposited directly upon the substrate. It may instead be deposited upon a previously applied layer or structure. In one application, an MCrAlY underlayer is first applied to the substrate. The platinum-group-containing layer is deposited overlying and contacting the MCrAlY underlayer, and may be interdiffused with the MCrAlY underlayer. In a similar application, a NiAl-base underlayer (which may include other alloying elements such as Cr and Zr) is applied to the substrate. The platinum-group-containing layer is deposited overlying and contacting the NiAl-base underlayer, and may be interdiffused with the NiAl-base underlayer.

In a preferred approach, a method for depositing a platinum-group-containing layer on a substrate comprises the steps of furnishing the substrate, preparing a water-base paint comprising metallic platinum-group powder, water, and a binder, spraying the water-base paint overlying the substrate to form a platinum-group-containing layer, and thereafter heating the platinum-group-containing layer to interdiffuse the platinum-group-containing layer and the substrate. Other compatible processing, such as that described herein, may be employed in conjunction with this approach.

The present approach provides important advances in the art of platinum-group-containing layers and coatings by using a water-base platinum-group-containing paint that does not produce volatile organic compounds during application or subsequent processing. The water-base platinum-group-containing paint may be applied to the substrate by spraying, which produces a uniform and thin deposited layer that is suitable for interdiffusion and is suitable for further processing into a platinum-group/aluminide layer. Spray application is fast and economical, and may be used for irregularly shaped substrate workpieces and in situations where only a portion of the surface is to be coated and another portion is masked.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
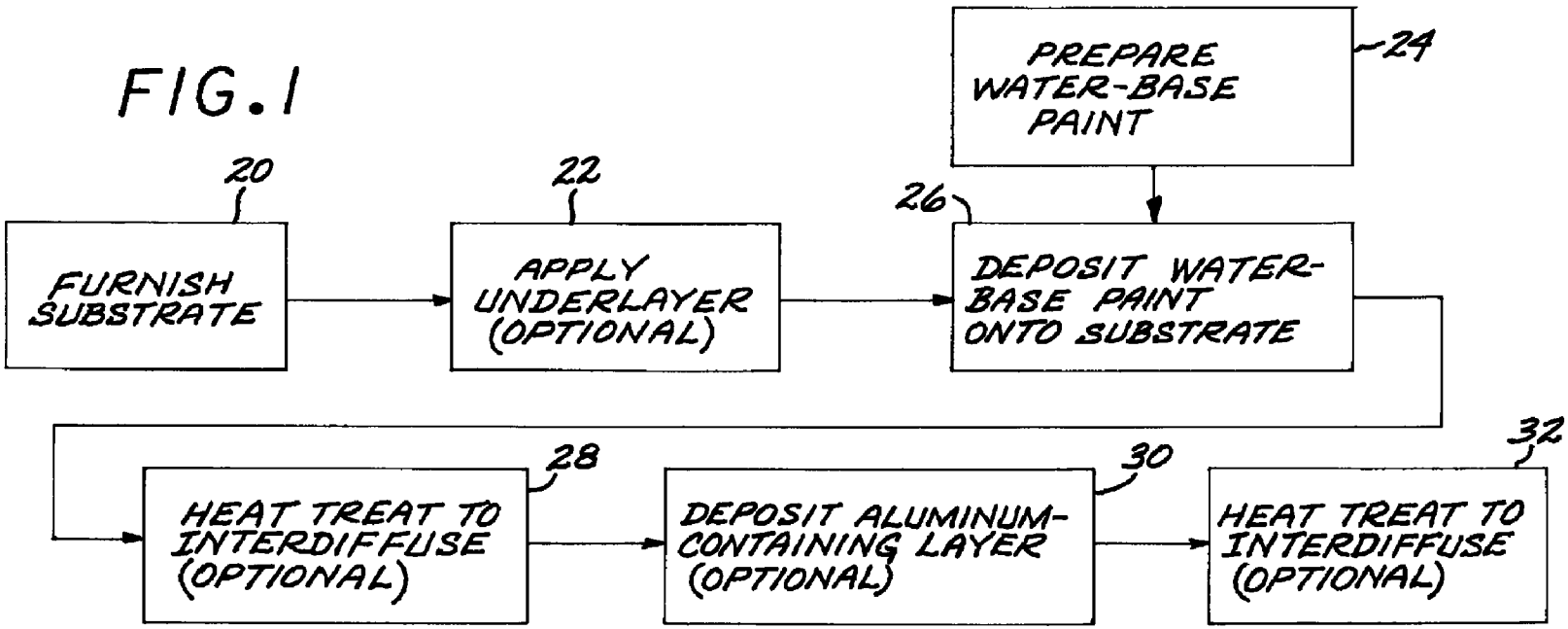
FIG. 1 is a block flow diagram of a method for depositing a platinum-group-containing layer on a substrate.
Figure 2:
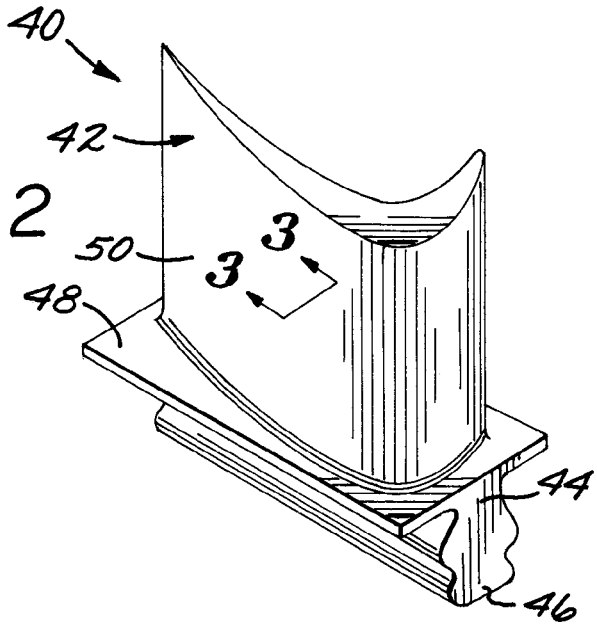
FIG. 2 is a perspective view of an example of a substrate operable with the present approach.

FIG. 1 depicts the steps in a method for depositing a platinum-group-containing layer on a substrate. The substrate is furnished, numeral 20. Any operable substrate may be used, and examples include a gas turbine blade and particularly its airfoil, a gas turbine vane and particularly its airfoil, and a gas turbine combustor splash plate. FIG. 2 depicts a gas turbine blade 40. The gas turbine blade 40 has an airfoil 42 against which the flow of hot combustion gas impinges during service operation, a downwardly extending shank 44, and an attachment in the form of a dovetail 46, which attaches the gas turbine blade 40 to a gas turbine disk (not shown) of the gas turbine engine. A platform 48 extends transversely outwardly at a location between the airfoil 42, and the shank 44 and dovetail 46. In one application, the airfoil 42 serves as the substrate 50 for subsequent deposition. The entire gas turbine blade 40 is preferably made of a nickel-base superalloy. A nickel-base alloy has more nickel than any other element, and a nickel-base superalloy is a nickel-base alloy that is strengthened by the precipitation of gamma-prime phase or a related phase.

The substrate 50 is typically processed to remove any preexisting scale, excessive oxide or corrosion, dirt, or other contamination in the areas to be painted. The cleaning procedure is appropriate to the nature of the contamination. One effective technique is to use fine grit blasting on the substrate 50, which also prepares the surface to receive the subsequently deposited water-base paint.

Figure 3:
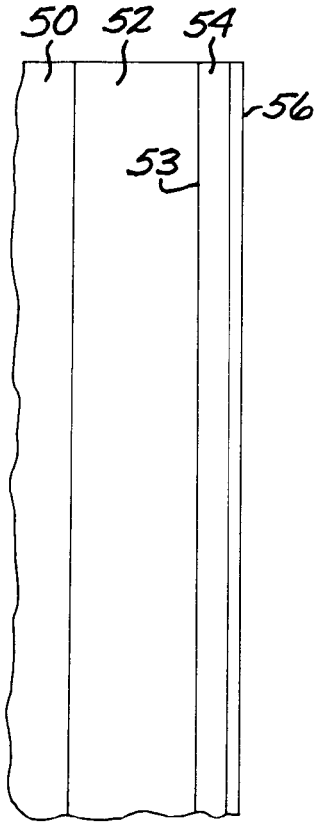
FIG. 3 is an enlarged sectional view through the substrate of FIG. 2, taken on lines 3-3 at the start of the deposition of the aluminum-containing layer and prior to any significant interdiffusion.
Figure 4:
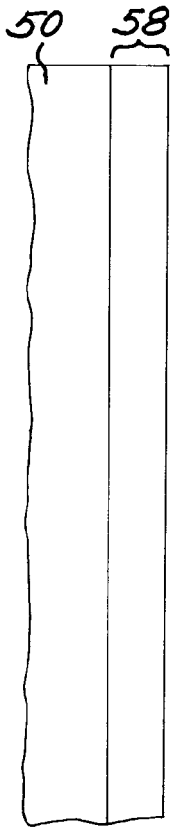
FIG. 4 is an enlarged sectional view through the substrate of FIG. 2, taken on lines 3-3 after continuing deposition of the aluminum-containing layer at elevated temperature and after interdiffusion, in the absence of an underlayer.

Optionally, an underlayer 52 may be applied, numeral 22 of FIG. 1, to a surface 54 of the substrate 50, as shown in FIGS. 3 and 4. Examples of underlayers 52 include a MCrAlY coating or a NiAl-base coating that may also contain alloying elements such as Cr and Zr. The MCrAlY coating is an overlay coating, and the NiAl-base coating is a diffusional coating.

A water-base paint comprising metallic platinum-group powder, water, and a binder is prepared, numeral 24 of FIG. 1. Any operable platinum-group powder may be used. The preferred metallic platinum powder has a globular particle shape and an average particle size of about 0.2 micrometers. Such a powder is available as Johnson Matthey 100/2A powder. The binder is preferably methyl cellulose, available in solid powder form from Fisher Scientific Co. Methyl cellulose forms polyethylene oxide during subsequent heating, which is completely volatilized in the subsequent heating steps. The water is preferably de-ionized water. The water and the binder are removed during subsequent processing.

The platinum-group powder, water, and binder are mixed together in an operable ratio. Most preferably, the platinum-group powder is present as 25 to 40 percent by weight of the total mixture, the methyl cellulose is present as 10 to 30 percent by weight of the total mixture, and the water is the balance. The amount of water may be adjusted as desired to control the fluidity and consistency of the mixture as necessary for the selected application technique. This mixture is first manually mixed by hand or by machine stirring, and then is further mixed and compounded by mixing in a ball mill without media for at least 1 hour. The resulting mixture performs satisfactorily as a paint, with the platinum-group particles remaining in suspension for an extended period of time. If the paint is not used immediately after mixing and compounding, it may be used at a later time after mechanical re-stirring.

Figure 5:
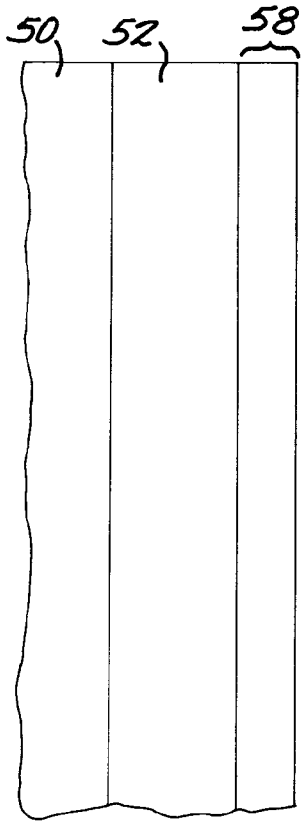
FIG. 5 is an enlarged sectional view through the substrate of FIG. 2, taken on lines 3-3 after continuing deposition of the aluminum-containing layer at elevated temperature and after interdiffusion.

The water-base paint is deposited, step 26, overlying a surface 53 of the substrate 50 (or underlayer 52 if present) to form a platinum-group-containing layer 54, as shown in FIG. 3. (FIGS. 3-5 are not drawn to scale.) If optional step 22 is not performed, the water-base paint is deposited directly onto and in contact with the substrate 50. If optional step 22 is performed, the water-base paint is deposited onto and in contact with the underlay 52. In either case, the water-based paint overlies the substrate 50, and may in some embodiments contact the substrate 50. That is, "overlying" means that the layer lies over but does not necessarily contact the surface, while "overlying and contacting" means that the layer lies over and does necessarily contact the surface. In the case of the gas turbine blade 40 of FIG. 2 or a gas turbine vane, the preferred region for deposition 26 is the airfoil 42.

The water-base paint may be applied by any operable approach. Examples include air or airless spraying, dipping, spinning, and brushing. The viscosity consistency of the water-base paint may be adjusted by adding a higher proportion of water.

The greatest advantages of the water-base paint are realized when it is sprayed onto the substrate 50 or the underlayer 52. The particular formulation of the water-base paint allows it to be sprayed through fine nozzles, and it may be thinned as needed with the addition of more water. Spraying deposits a thin liquid layer that dries as the water evaporates. The sprayed paint layer, and thence the platinum-group-containing layer 54, may be made highly uniform using automated spraying and, with skill, even using manual spraying. Fine details of the substrate article may be uniformly painted, for example by using an airbrush. Areas of the surface that are not to be painted may be masked to prevent any deposition of the water-based paint.

Another advantage of spraying is that the thickness of the as-deposited layer may be carefully controlled. Because the platinum-group metals are expensive, the thickness of the platinum-group-containing layer 34 is made no thicker than necessary to accomplish the required protective function. For most applications, the platinum-group-containing layer 54 is preferably from 0.0001 to 0.0003 inches in thickness, after drying and subsequent heat treatment. If the layer 54 is thicker, an undesirable gold-colored $PtAl_2$ phase is formed, and platinum-group metal is wasted. If the layer 54 is thinner, there is a risk of pinholes through the layer 54 and unpainted areas. Normally, a single coat of the water-based paint is sufficient and is preferred. Such a single coat is preferably accomplished by a single pass of the paint sprayer. However, if desired, two or more coats may be applied to build up the thickness of the platinum-group-containing layer 54, allowing each coat to dry before the next coat is applied. If a thicker platinum-group-containing layer is desired, it is preferred to create that thicker platinum-group-containing layer using multiple thin coats rather than a single thick coat. Desirably, the final platinum-group-containing layer 54 includes at least 96 percent, more preferably at least 99 percent, platinum-group metal (or mixture of platinum group metals) by weight exclusive of the water and the binder. It is preferred that there be less than 100 parts per million (ppm), more preferably less than 25 ppm, total of the elements sulfur and carbon. Sulfur and carbon, when present in larger amounts, may contribute to the degradation of the coating during service.

After the water-based paint is deposited upon the substrate 50, the water therein quickly evaporates so that the paint dries to the touch, resulting in the platinum-group containing layer 54 on the substrate 50. The platinum-group-containing layer 54 may be used in this as-deposited-and-dried state. More typically, however, it is further processed.

Optionally, the platinum-group-containing layer 54 is heated, to interdiffuse the platinum-group-containing layer 54 and the substrate 50 (or underlayer 52, if present), step 28. Atoms of the platinum-group metal(s) diffuse into the substrate 50 (or the underlayer 52, if present), and atoms of the substrate 50 (or the underlayer 52, if present) diffuse into the platinum-group-containing layer 54. This interdiffusion serves to densify the platinum-group-containing layer 54, to bind the platinum-group-containing layer 54 more strongly to the substrate 50 (or the underlayer 52, if present), and to create a surface compositional gradient. Any operable heat treatment 28 may be used. In a preferred approach, the heating 28 is at 1950° F. for 4 hours in vacuum. The result is that the platinum-group-containing layer 54 becomes highly adherent and highly corrosion-resistant. The interdiffused substrate 50, underlayer 52 if present, and platinum-group containing layer 54 may be used in this state, or may be further processed as described next.

In yet a further optional processing, an aluminum-containing layer 56 is deposited in contact with the platinum-group-containing layer, numeral 30. The aluminum-containing layer 56 may be pure aluminum or an aluminum alloy. The aluminum-containing layer 56 may be deposited by any operable technique. Examples of operable deposition techniques include chemical vapor deposition, vapor phase aluminiding, or physical vapor deposition. The thickness of the aluminum-containing layer 56 is typically approximately the same as the initial thickness of the platinum-group-containing layer 54 prior to interdiffusion, or slightly thicker. In the preferred embodiment, the aluminum-containing layer 56 has about the same thickness as the platinum-group-containing layer 54.

Optionally but preferably, the substrate 50, the underlayer 52 if present, the platinum-group-containing layer 54, and the aluminum-containing layer 56 are then heated, step 32, to interdiffuse the atoms of the aluminum-containing layer 56, the platinum-group-containing layer 54, the underlayer 52 if present, and the substrate 50. Any operable heat treatment 32 may be used. In a preferred approach, the heating 32 is at 1975° F. for 6 hours in a flow of 150 standard cubic feet per hour of argon. The result is an interdiffused layer 58, as illustrated in FIG. 4 for the case of no underlayer, and in FIG. 5 for the case of an underlayer 52. The interdiffused layer 58 forms the exposed surface but penetrates into the substrate 50 (or underlayer 52, if present) for a substantial distance, typically 40-60 micrometers or more. The interdiffused layer 58 is formed of platinum, aluminum, and atoms from the substrate 50 (or underlayer 52, if present).

The present invention has been reduced to practice using the processing defined by steps 20, 24, 26, 28, 30, and 32, using the preferred values discussed above. The substrate 50 was Rene™ N5 alloy, having a nominal composition in weight percent of about 7.5 percent cobalt, about 7.0 percent chromium, about 1.5 percent molybdenum, about 5 percent tungsten, about 3 percent rhenium, about 6.5 percent tantalum, about 6.2 percent aluminum, about 0.15 percent hafnium, about 0.05 percent carbon, about 0.004 percent boron, about 0.01 percent yttrium, balance nickel and minor elements. The as-deposited platinum-group-containing layer 54 was pure platinum about 3-4 micrometers thick deposited by spraying. The aluminum-containing layer 56 was pure aluminum deposited by vapor phase aluminiding. The vapor phase aluminiding was accomplished at elevated temperature, so that the resulting structure was like that shown in FIG. 4. After the diffusion, distinct layers 54 and 56 are not present, but instead the structure has the interdiffused layer 58.

Figure 6:
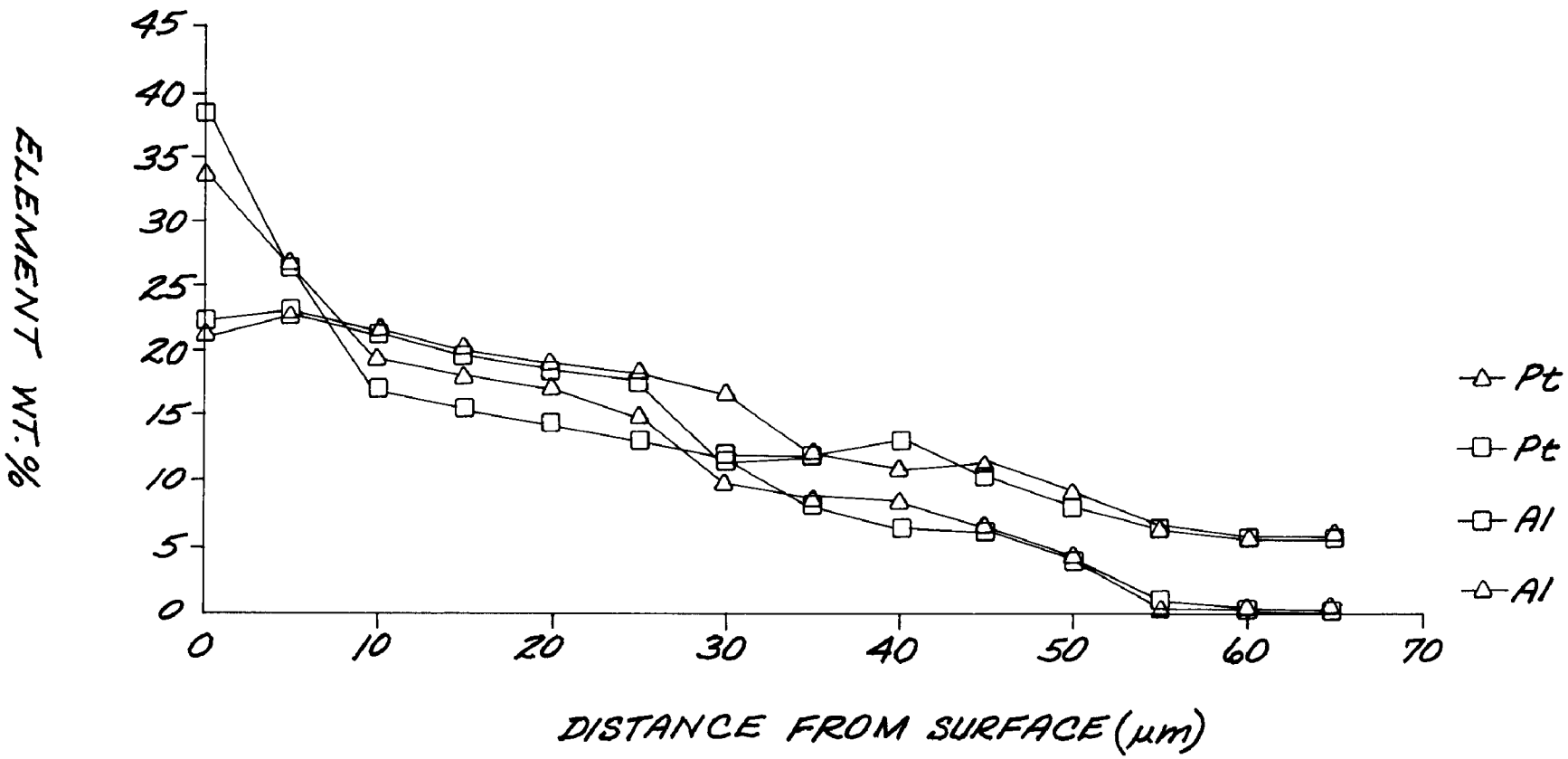
FIG. 6 is a graph of composition as a function of distance from the surface of the specimen.

The chemical composition of the specimen was measured as a function of distance from the surface of the specimen. FIG. 6 presents the chemical composition profile for the platinum and aluminum as a function of distance from the free surface (the remainder of the composition is elements diffused from the substrate 50). The profile was measured at two different locations, resulting in two sets of values for the platinum and aluminum. These two sets of values agree well. The composition profile of FIG. 6 is similar to that produced by a conventional approach of depositing platinum by electrodeposition and depositing aluminum by chemical vapor deposition. The average composition integrated in the first 20 micrometers below the free surface for this test specimen is 21.9-weight percent platinum and 21.2 weight percent aluminum, which is satisfactory for a platinum-aluminum protective layer.

Figure 7:
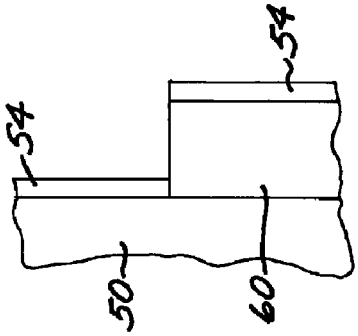
FIG. 7 is an enlarged sectional view through the substrate of FIG. 2, taken on lines 3-3, illustrating the use of a mask.

In some instances, it is preferred to apply the platinum-containing layer 54 and optionally the aluminum-containing layer 56 overlying only a portion of the substrate 50, while leaving other portions bare. As shown in FIG. 7, a mask 60 may be placed over the portion of the substrate 50 that is not to be coated with the layers 54 and 56. The layers 54 and 56 are deposited, and the mask 60 is thereafter stripped away to leave the previously masked portion uncoated. The mask 60 may be of any operable form. For spraying the layer 54, the mask 60 may be paper, tape, or the like. For depositing the layer 56 by an elevated temperature process, the mask 60 must withstand the deposition temperature. In some cases, it may be desirable to deposit both layers 54 and 56 in some areas, and only the layer 54 or the layer 56 (but not both) in other areas.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for depositing a platinum-group-containing layer on a nickel-base superalloy substrate, comprising the steps of:

furnishing the nickel-base superalloy substrate;

preparing a water-base paint comprising water, a methyl cellulose binder, and a metallic platinum group powder selected from the group consisting of platinum powder, palladium powder, rhodium powder, iridium powder, ruthenium powder, osmium powder, and combinations thereof;

depositing the water-base paint onto the nickel-base superalloy substrate; and air-drying the water-base paint to evaporate the water from the water-base paint, thereby forming the platinum-group-containing layer on the nickel-base superalloy substrate.

2. The method of claim 1, wherein the step of furnishing includes the step of furnishing the nickel-base superalloy substrate that is a gas turbine blade, a gas turbine vane, or a gas turbine combustor splash plate.

3. The method of claim 1, wherein the step of preparing includes the step of mixing from about 25 to about 40 percent by weight metallic platinum-group powder with water and the methyl cellulose binder.

4. The method of claim 1, wherein the step of depositing the water-base paint includes the step of spraying the water-base paint onto the surface of the nickel-base superalloy substrate.

5. The method of claim 1, wherein the step of air-drying the water-base paint includes forming the platinum-group-containing layer to a thickness of from about 0.0001 to about 0.0003 inches.

6. The method of claim 1, wherein the steps of preparing, depositing, and air-drying the water-base paint cooperate in producing the platinum-group-containing layer including at least about 96 percent platinum-group metal by weight exclusive of the water and the binder.

7. The method of claim 1, including an additional step, after the step of depositing the water-base paint, of heating the platinum-group-containing layer to interdiffuse the platinum-group-containing layer with the underlying nickel-base superalloy substrate.

8. The method of claim 1, including an additional step of depositing an aluminum-containing layer in contact with the platinum-group-containing layer.

9. The method of claim 1, including additional steps of depositing an aluminum-containing layer in contact with the platinum-group-containing layer, and heating the aluminum-containing layer and the platinum-group-containing layer to interdiffuse the aluminum-containing layer and the platinum-group-containing layer.

10. The method of claim 1, including an additional step, after the step of furnishing and before the step of depositing the water-base paint, of applying a MCrAlY underlayer to the nickel-base superalloy substrate, and wherein the step of depositing includes the step of depositing the platinum-group-containing layer onto and contacting the MCrAlY underlayer.

11. The method of claim 1, including an additional step, after the step of furnishing and before the step of depositing the water-base paint, of applying a NiAl-base underlayer to the nickel-base superalloy substrate, and wherein the step of depositing includes the step of depositing the platinum-group-containing layer overlying and contacting the NiAl-base underlayer.

12. A method for depositing a platinum-group-containing layer on a substrate, comprising the steps of:

furnishing the substrate;

preparing a water-base paint comprising water, a methyl cellulose binder, and a metallic platinum group powder selected from the group consisting of platinum powder, palladium powder, rhodium powder, iridium powder, ruthenium powder, osmium powder, and combinations thereof;

spraying the water-base paint onto the substrate to form the platinum-group-containing layer; and thereafter heating the platinum-group-containing layer at a temperature between approximately 1900° F. to approximately 2000° F. under vacuum to interdiffuse the platinum-group-containing layer with the underlying substrate.

13. The method of claim 12, including additional steps, after the step of heating the platinum-group-containing layer, of:

depositing an aluminum-containing layer in contact with the platinum-group-containing layer, and thereafter heating the aluminum-containing layer and the platinum-group-containing layer at a temperature of approximately 1975° F. in a flow of argon to interdiffuse the aluminum-containing layer and the underlying platinum-group-containing layer.

14. The method of claim 12, wherein the step of furnishing includes the step of furnishing a nickel-base superalloy substrate that is a turbine blade or a turbine vane or a combustor splash plate.

15. The method of claim 12, including an additional step, after the step of furnishing and before the step of depositing the water-base paint, of applying a MCrAlY underlayer to the substrate, and wherein the step of depositing includes the step of depositing the platinum-group-containing layer overlying and contacting the MCrAlY underlayer.

16. The method of claim 12, including an additional step, after the step of furnishing and before the step of depositing the water-base paint, of applying a NiAl-base underlayer to the substrate, and wherein the step of depositing includes the step of depositing the platinum-group-containing layer overlying and contacting the NiAl-base underlayer.

* * * * *